United States Patent [19]

Streicher

[11] Patent Number: 4,540,350

[45] Date of Patent: Sep. 10, 1985

[54] STRICTURE PUMP

[76] Inventor: Manfred Streicher, Bahnhofstrasse 22, 7141 Beilstein, Fed. Rep. of Germany

[21] Appl. No.: 610,011

[22] Filed: May 14, 1984

[30] Foreign Application Priority Data

Jun. 3, 1983 [DE] Fed. Rep. of Germany ..... 3320091

[51] Int. Cl.[3] ..... F04B 43/12; F04B 45/08

[52] U.S. Cl. ..... 417/475; 417/477

[58] Field of Search ..... 417/477, 476, 475

[56] References Cited

U.S. PATENT DOCUMENTS

| | | | |
|---|---|---|---|
| 2,123,781 | 7/1938 | Huber | 417/477 |
| 2,899,905 | 8/1959 | Becher | 417/477 |
| 3,105,447 | 10/1963 | Ruppert | 417/477 X |
| 3,180,272 | 4/1965 | Broadfoot | 417/477 X |
| 3,768,934 | 10/1973 | Magerle | 417/477 |

*Primary Examiner*—Richard E. Gluck

*Attorney, Agent, or Firm*—Schwartz, Jeffery, Schwaab, Mack, Blumenthal & Evans

[57] ABSTRACT

A stricture pump (30) comprising a casing (31) containing a delivery hose (32), a rotor (33) and a band-like dividing member (34) which is substantially stable in respect of length, and which is fastened to a fastening part (53, 55, 57) outside the outermost periphery of the rotor, in such a manner as to be fixed to the casing, and in addition is disposed around the rotor. Together with the casing walls, the dividing member closes off sealingly a suction chamber (38.1). On the rotation of the rotor, this closed-off suction chamber is increased in size, whereby a negative pressure is produced in it. Fluid is thereby forced from a suction branch (45) into that portion of the hose which lies within the suction chamber. On the further rotation of the rotor, the fluid drawn in is pressed out of the hose by rollers (52) on the rotor, these rollers pressing by way of the dividing member (34) against the hose disposed between the dividing member and the peripheral wall (37) of the casing. The hose has substantially no restoring power of its own, and therefore draws in fluid not through its own restoring power but through the negative pressure in the suction chamber. A stricture pump of this kind can be operated at a very high speed of rotation, so that high output can be achieved.

12 Claims, 26 Drawing Figures

FIG. 4.1
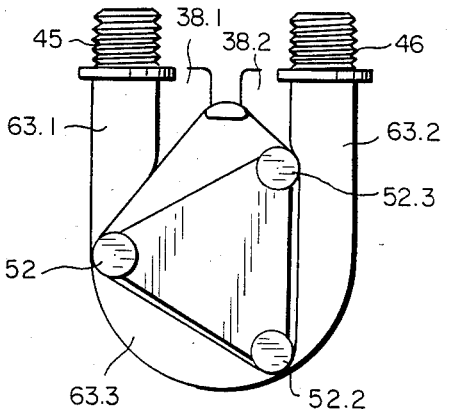
FIG. 4.2
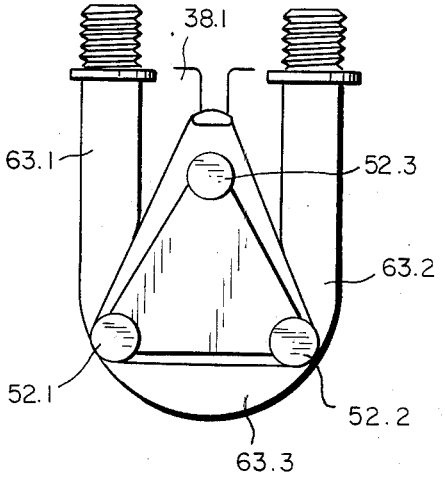
FIG. 4.3
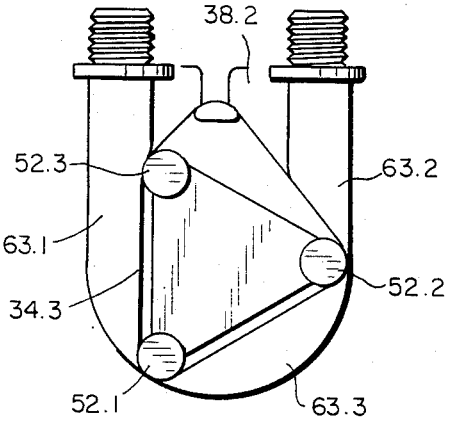
FIG. 4.4
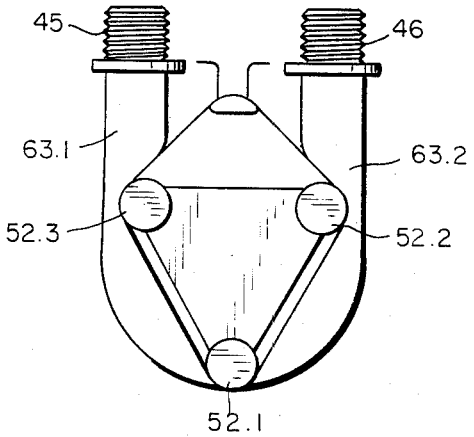
FIG. 5
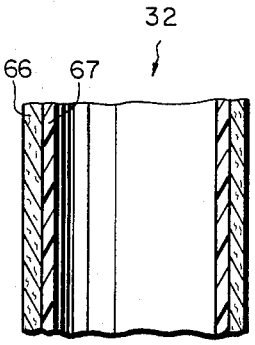
FIG. 6
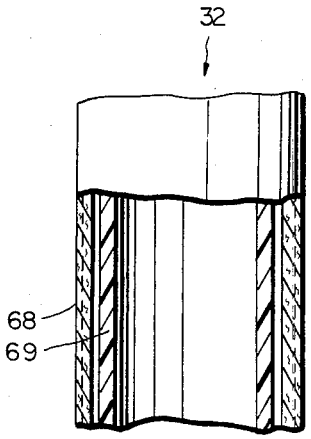

STRICTURE PUMP

FIELD OF THE INVENTION

The invention relates to a stricture pump in which a rotor rotates, in the interior of a casing, in the direction from a suction chamber to a delivery chamber and compresses a hose disposed, between a suction branch and a delivery branch, along a peripheral wall of the casing.

PRIOR ART

In stricture pumps of the most widely used type the hose is so constructed that it has great restoring power for the purpose of recovering its shape after compression by the rotor, even with considerable negative pressure, and thus of re-applying suction to a fluid. In order to be able to achieve high negative suction pressures, the hose must be very stiff, so that considerable force is required for its compression, which results in a heavy, bulky pump. The speed of rotation of the rotor can only be very low because the hose requires a relatively long time to return from the constricted state to its original condition. For this flexing work against heavy forces, a high power is required in order to deform the hose, which because of the work of deformation is also heated to a relatively great extent.

These disadvantages are avoided with a stricture pump having a hose possessing substantially no restoring power of its own. After its compression the hose is restored to shape through the negative pressure prevailing in the entire pump casing. The negative pressure is continuously maintained by a vacuum pump connected to the casing. This pump has the advantage that the rotor can rotate at a considerably higher speed, because the negative pressure present restores the compressed hose to shape immediately, thus drawing in further fluid, after the rotor has moved further. The flexing power needed is substantially less, so that the hose is also heated to a considerably smaller extent and thus subjected to less wear. However, this pump has the disadvantage that an additional vacuum pump is required, so that once again the entire construction becomes heavy and expensive. On the delivery side the hose must be compressed against the force of the negative pressure, which constitutes needless expenditure of work.

SUMMARY OF THE INVENTION

The problem underlying the invention is that of indicating a stricture pump which is of simple, light construction.

The invention is constituted by the features of Claim 1. Advantageous embodiments are the subject of the sub-claims. The features of the sub-claims can be applied in any combination with one another, provided that they are not obviously mutually exclusive.

In addition to a rotor and a hose, the stricture pump according to the invention also has, in a casing, a band-like dividing member which is substantially stable in respect of length, and which is fastened in the interior space of the casing, between the delivery chamber and the suction chamber, to a fastening part outside the outermost periphery of the rotor, in such a manner as to be fixed to the casing, and in addition is disposed around the rotor. At least in its suction chamber portion, the dividing member is so wide that it bears against the rear end wall and against the front wall of the casing, and thus seal the suction chamber portion. To improve sealing, a sealing liquid is also provided in the interior of the casing. The rotor rotating in the fastened dividing member moves the latter to and fro, so that the suction chamber is alternately increased and reduced in size. When its size is increased, a negative pressure is produced, which reopens the hose, which was at first compressed by a constricting member on the rotor, so that the fluid to be pumped is forced onwards. The hose has substantially no restoring power of its own.

The pump according to the invention thus itself generates the negative pressure for the reopening of the hose, so that an additional vacuum pump is not required. The pump differs from conventional stricture pumps through the additional dividing member, the additional sealing liquid, and the slack hose used. A pump for a delivery power of about 30,000 liters per hour weighs only about 30 kg, whereas a conventional stricture pump of the same output weighs fifteen times as much and a stricture pump with an added vacuum pump weighs about five times as much. The pump runs at about 400 revolutions per minute, whereas a conventional pump runs at about 30 to 100 revolutions per minute.

BRIEF DESCRIPTION OF THE DRAWINGS

The invention will be explained more fully with the aid of examples of embodiment illustrated in the accompanying drawings, in which:

FIGS. 4 to 8 are cross-sections through different hoses;

DETAILED DESCRIPTION OF THE INVENTION

Figure 1:
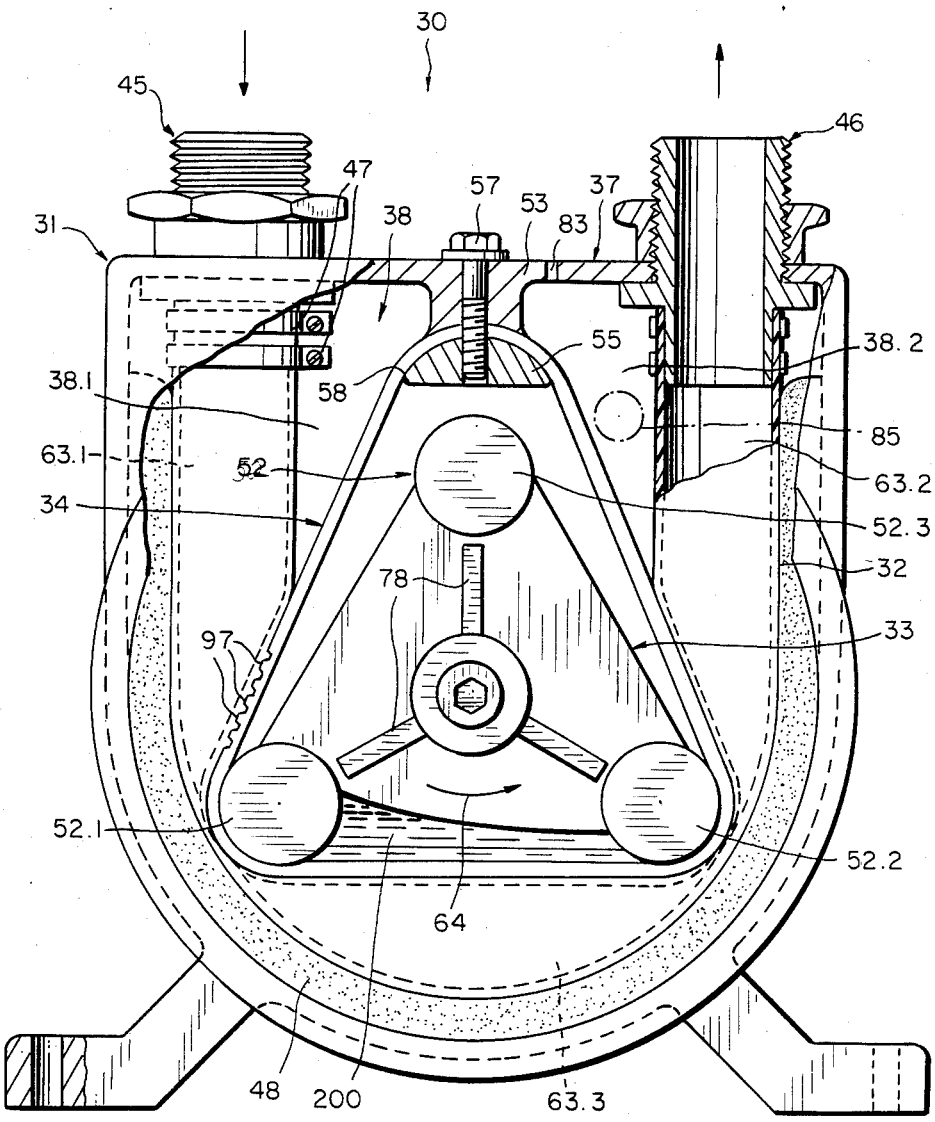
FIGS. 1 to 3 are respectively a longitudinal section, a cross-section and a plan view of a basic embodiment.
Figure 3:
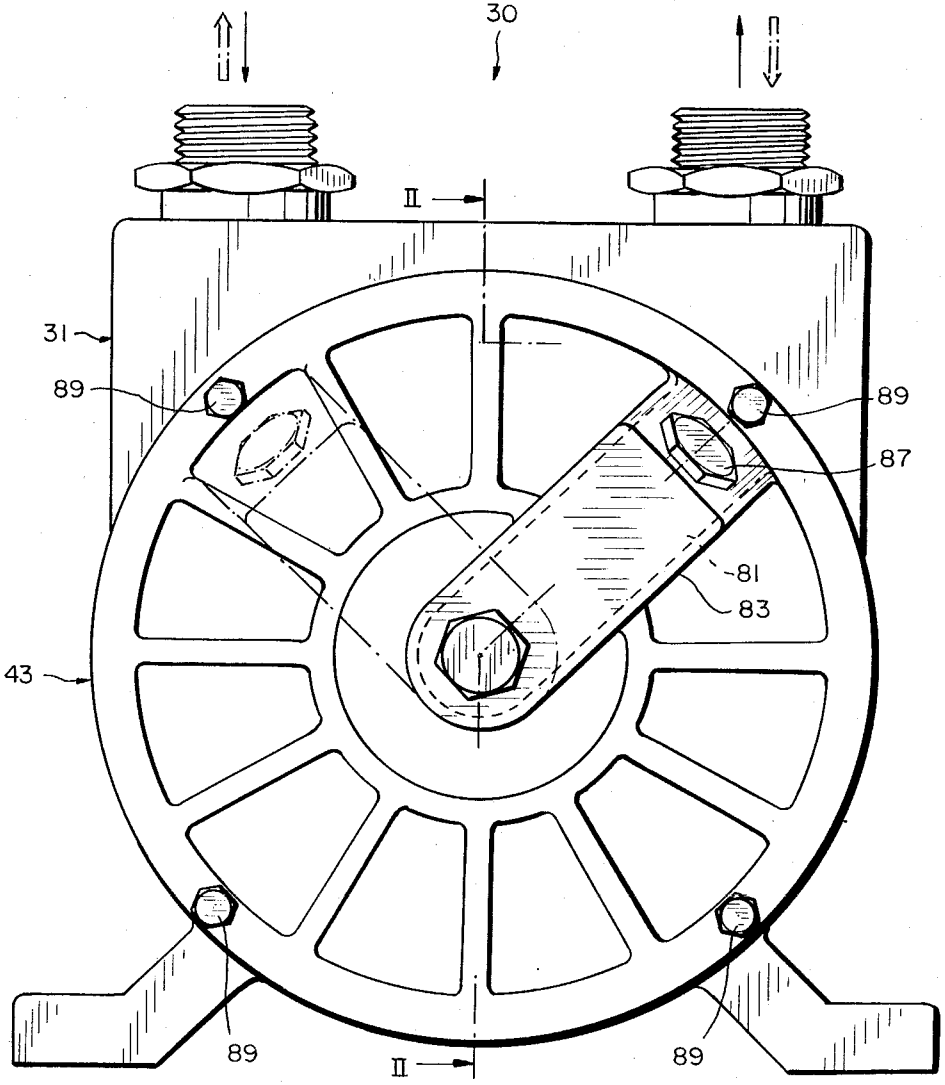
Figure 2:
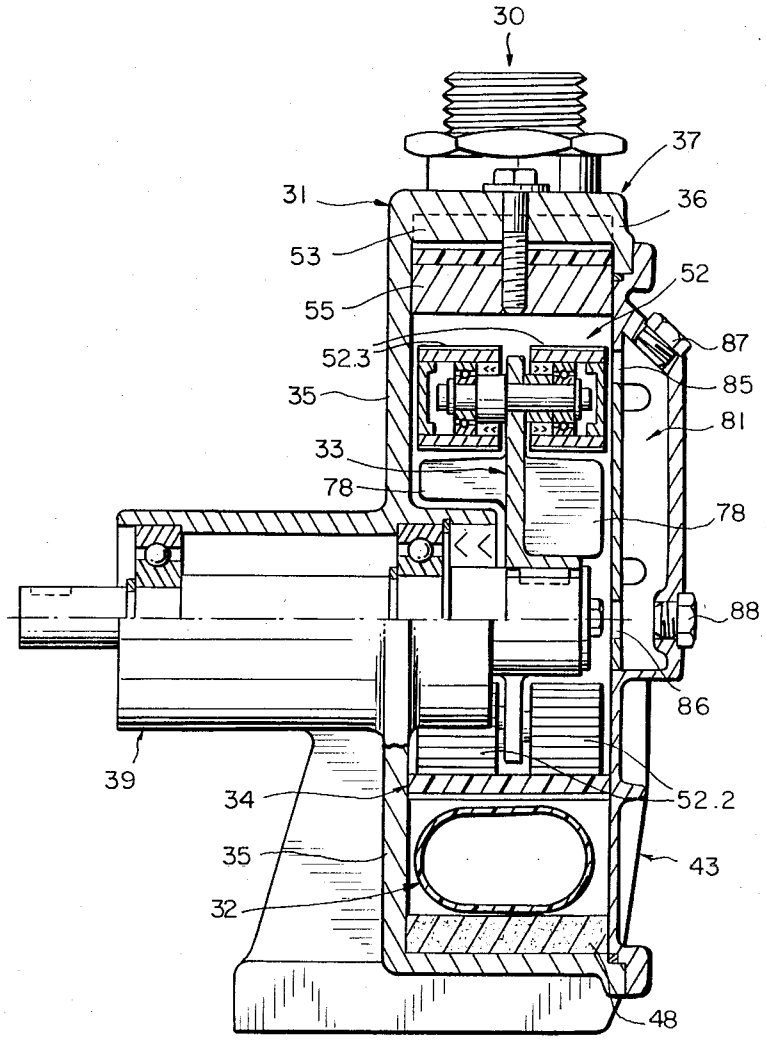

The stricture pump 30 in the example of embodiment shown in FIGS. 1 to 3 comprises, as its main components, a casing 31 and, in the interior of the latter, a delivery hose 32, a rotor 33 and a dividing member 34.

Externally, the casing 31 has roughly the shape of a cylindrical disc with a rear end wall 35, a front wall composed of a front end wall 36 and a cover 43, and a peripheral wall 37, an interior space 38 being enclosed by these walls.

The upper portion of the peripheral wall 37 is flat, and into this portion are inserted two branches, of which hereinbelow the branch on the left in each case is referred to as the suction branch 45 and the one on the right as the delivery branch 46. Which branch acts as suction branch and which as delivery branch will of course depend on the direction of rotation of the rotor 33. The hose 32 is fastened to the two branches 45 and 46, in a readily exchangeable manner, by means of hose clips 47. The hose 32 is disposed along the peripheral wall 37.

The rotor 33 is mounted in a bearing housing 39 connected to the rear end wall 35. The bearing housing may also be omitted if the rotor is mounted directly on the shaft of a drive motor. The rotor 33 is triangular in shape, with a pair of rollers 52 at each corner point.

The dividing member 34 is disposed around the rotor 33 and is fastened to the casing 31 by being clamped between a fastening rib 53 on the casing and a clamp member 55 adapted to be tightened by a clamp screw 57. The clamp member 55 is rounded, so that even when it moves to and fro it cannot kink. As can be seen in FIG. 2, the width of the dividing member 34 is so selected that it bridges the distance between the rear end wall 35 and the cover 43. The dividing member 34 is in the form of a band and substantially stable in respect of length.

In its bottom portion, lying opposite the flat connection branch region of the peripheral wall 37, the peripheral wall 37 is circular cylindrical in shape, the centre line of this circular cylindrical portion of the pump coinciding with the centre line of the rotor 33. The pump portion extends over at least half a circular cylinder. A resilient support 48 is disposed on the pump portion of the peripheral wall 37. The thickness of the support 48 is dimensioned such that the hose 32 is completely compressed between the dividing member 34 and the support 48 when a pair of rollers 52 runs past along the pump portion in the interior of the dividing member 34.

In the interior of the casing, particularly in the space enclosed by the dividing member 34, a sealing liquid 200 is provided. This liquid is introduced through a filler hole with a screw filler cap 87 in the cover 43 until the liquid passes out at the location of an inspection screw cap 88 in the centre of the cover, when this inspection cap has been removed. The inspection cap 88 and the filler cap 87 are then screwed in again.

The operation of the pump shown in FIGS. 1 to 3 will now be explained more fully with the aid of the cycle diagrams shown in FIGS. 4.1 to 4.4. It will be assumed that the rotor 33 rotates in the counterclockwise direction, that is to say in the direction of the arrow 64 in FIG. 1. In the position shown in FIG. 4.1 the rotor has turned so far that one of its pairs of rollers 52, which hereinafter will be referred to as the first pair 52.1, just completely compresses that portion of the hose coming from the suction branch 45. The casing walls and the dividing member 34 then divide off a part of the interior space 38, and this part will hereinafter be referred to as the suction chamber 38.1. In the hose 34, between the suction branch and the compression point, a suction chamber 63.1 is formed. By means of the pair of rollers 52.2 following in the direction of rotation, the hose 32 is compressed at another point. The chamber enclosed by the hose between this second compression point and the delivery branch 46 will hereinafter be referred to as the delivery chamber 63.2. The space which is surrounded by the casing walls and the dividing member 34, and which is in communication with the atmosphere by way of a vent opening 93 in the flat portion of the peripheral wall 37, will hereinafter be referred to as the delivery chamber 38.2. The space enclosed by the hose, between the first pair of rollers 52.1 and the second pair 52.2, will be referred to as the intermediate chamber 63.3. The volume of this intermediate chamber remains unchanged during the rotation of the rotor.

When the rotor rotates further in the counterclockwise direction and then assumes the position shown in FIG. 4.2, the volume of the suction chamber 38.1 has increased. Since this space is sealingly closed off by the casing walls and the dividing member 34, a negative pressure has been formed in it. This negative pressure has the consequence that the substantially slack hose 32 is inflated by fluid moving forward, so that the volume of the suction chamber 63.1 is increased. At the same time the volume of the delivery chamber 63.2 has been reduced by the second pair of rollers 52.2 rolling along the peripheral wall in the direction of the delivery branch 46. The pump has therefore drawn in fluid through the suction branch 45 and delivered fluid through the delivery branch 46.

As the rotor rotates further, the position shown in FIG. 4.3 is finally reached, in which the second pair of rollers 52.2 is situated shortly before its lift-off from the peripheral wall, and the third pair of rollers 52.3 is just about to compress the hose again in the region of the suction chamber 63.1. In the position shown in FIG. 4.4 only the first pair of rollers 52.1 is still in contact with the peripheral wall, so that no intermediate chamber 63.3 is now closed off. The pump is shortly before the initial state shown in FIG. 4.1, on the reaching of which, however, the third pair of rollers 52.3 takes over the function of the pair of rollers 52.1 shown in FIG. 4.1.

On the delivery side the stricture pump 30 therefore acts as a conventional stricture pump, in which fluid is forced out of a hose by a constricting member. On the suction side, however, the pump 30 acts in such a manner as to form, with the aid of the dividing member 34, a suction chamber 38.1 which increases in size on the rotation of the rotor 33 and in which the pressure falls further and further, so that finally it becomes lower than the pressure in the suction chamber 63.1 of the delivery hose 32, with the consequence that fluid to be pumped is forced into the suction chamber 63.1.

The operation of the pump is therefore substantially dependent on the vacuum-tight closure between the dividing member 34 and the rear end wall 35 and the cover 43, this purpose being served by the previously mentioned sealing liquid inside the dividing member 34. This sealing liquid is however partly drawn by suction into the suction chamber 38.1 and, on the rotation of the rotor 33, passes into the delivery chamber 38.2. In order to enable the sealing liquid thereupon to pass back into the space enclosed by the dividing member 34 again, the pump 30 has a transfer opening 85 in the casing cover in the region of the delivery chamber 38.2, another transfer opening 86 in the centre of the cover, and a transfer duct 81 connecting the two openings. The rotor 33 carries wing-like ribs 78, which spray the returned sealing liquid onto the inner side of the dividing member 34, so that the sealing liquid can there once again carry out its sealing function.

For the purpose of changing a hose 32, the sealing liquid is extracted by opening the cover 43 by removing the screws 89, the hose clips 47 are unscrewed, the worn hose is removed, and a new hose is then fitted by the reverse sequence of operations. The cover can then also be replaced in a position offset by 90° if the pump is to be used in the other direction of rotation, that is to say in the clockwise direction. The rotation of the cover has the effect that the transfer duct 81 once again makes the connection between the delivery chamber 38.2 and the central chamber. The offset position is indicated in dot-dash lines in FIG. 3, while the directions of the pumped fluid are also shown in dot-dash lines.

Figure 7:
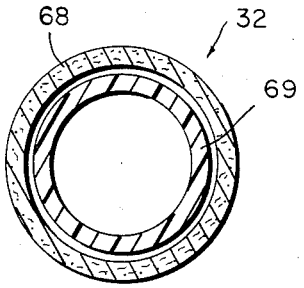
Figure 8:
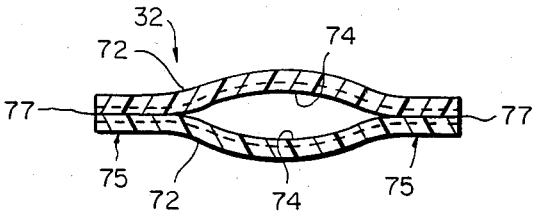

The delivery hose 32 is for example a normal hose of plastics material. It may however also be formed by a strong outer skin 66 of textile material with an interior coating 67 of plastics material resistant to the fluid which is to be pumped (FIG. 5). The delivery hose 32 may also consist of an outer hose 68 of textile material which substantially withstands the negative pressure forces occurring, and of a less strong, resistant inner hose 69 (FIGS. 6 and 7). The hoses are advantageously connected in each case to connectors by means of hose clips in such a manner that they can be disconnected from the connectors, and thus changed, without opening the cover of the pump.

Figure 9:
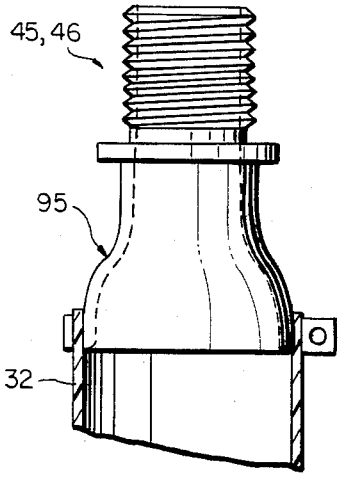
FIGS. 9 to 11 show embodiments of connection branches for oval hoses.
Figure 10:
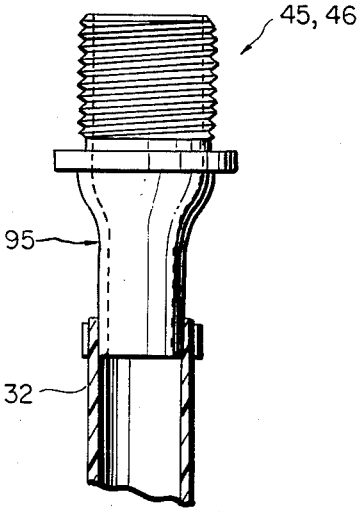
Figure 11:
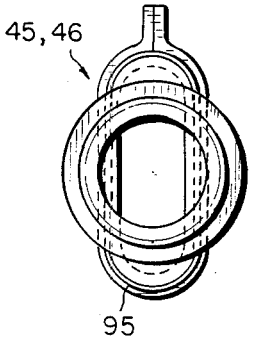

It should be noted that in a stricture pump the greatest forces on the hose occur at its edges which are squeezed flat. It is therefore proposed to use a hose which is preshaped in the compressed shape. The bending-open of the hose then extends substantially over its entire periphery, so that the greatly curved region is less heavily loaded than in the reverse case of a circular hose being heavily squeezed at the closely defined borders. The periphery of the hose should in every case be so dimensioned that it is not larger than twice the distance between the rear end wall 35 and the cover 43, so that in the squeezed state the hose can lie flat and without folds on the support 48. One embodiment of a flat hose consists of two flat webs 72, whose surfaces provided with respective coatings 74 are laid one on the other and which are joined together by a seam 77 in their edge regions 75. However, a one-piece preshaped plastics hose is still more advantageous. For the connection of such flat hoses to the suction branch 45 or to the delivery branch 46 it is advantageous to use hose nozzles 95 matching the shape of the hose (FIGS. 9 to 11).

Figure 12:
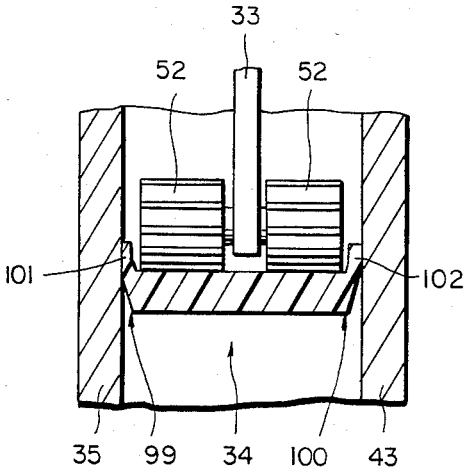
FIGS. 12 to 14 are sections through embodiments of dividing members.
Figure 13:
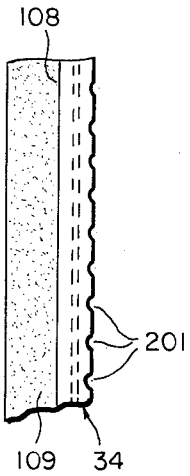
Figure 14:
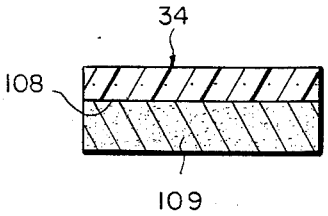

In order to ensure that the dividing member 34 makes a good seal against the rear end wall 35 and the cover 43, it is advantageously provided on its two longitudinal edges 99 and 100 with respective sealing lips 101 and 102 (FIG. 12). The sealing lips can be so constructed that they provide a seal only against one side or else against two sides. Sealing against one side, namely from the higher pressure in the interior space to the lower pressure in the suction chamber 38.1, is generally sufficient.

In order that the dividing member may apply a squeezing action to the hose 32 with the greatest possible elasticity, it is advantageously provided with a resilient layer 109 on its outer face 108. The dividing member itself advantageously has a reinforcing insert. It is advantageously provided on its inner face with transverse corrugation 201, which contributes towards uniformly distributing the sealing liquid, without a slipping effect between the rollers 52 and the dividing member 34, along the latter. The rollers 52 may instead be provided with transverse corrugation. If sliding constricting members are used instead of rollers 52, it is on the other hand advantageous to use a dividing member 34 not provided with corrugation, so that these sliding members slide on a film of sealing liquid on the dividing member. If the dividing member 34 does not have a resilient layer 109, but the support 48 on the peripheral wall 37 is by itself made sufficiently resilient, it is advantageous to provide transverse corrugation 97 on the outer face 108 of the dividing member 34, as shown in FIG. 1. This transverse corrugation has the effect that between the support 48 and the roller 52, with the dividing member 34 lying between them, the hose is compressed at a plurality of points, so that multiple sealing is achieved against the flow of fluid out of the intermediate chamber 63.3 of the hose 30. In the region of the delivery chamber 38.2 the dividing member can also be made narrower than in the region of the suction chamber 38.1, since it is no longer necessary to form a closed-off space in the delivery chamber. A dividing member 34 made narrower in the delivery chamber portion also ensures that sealing liquid delivered into the delivery chamber can easily pass back into the space surrounded by the dividing member 34.

Figure 15:
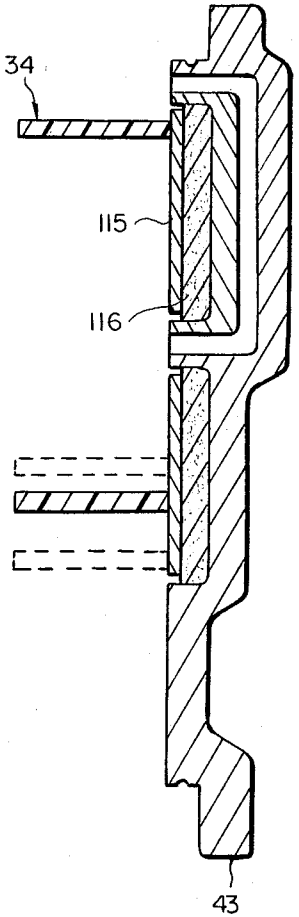
FIG. 15 is a cross-section through a cover having a resilient wall region.
Figure 17:
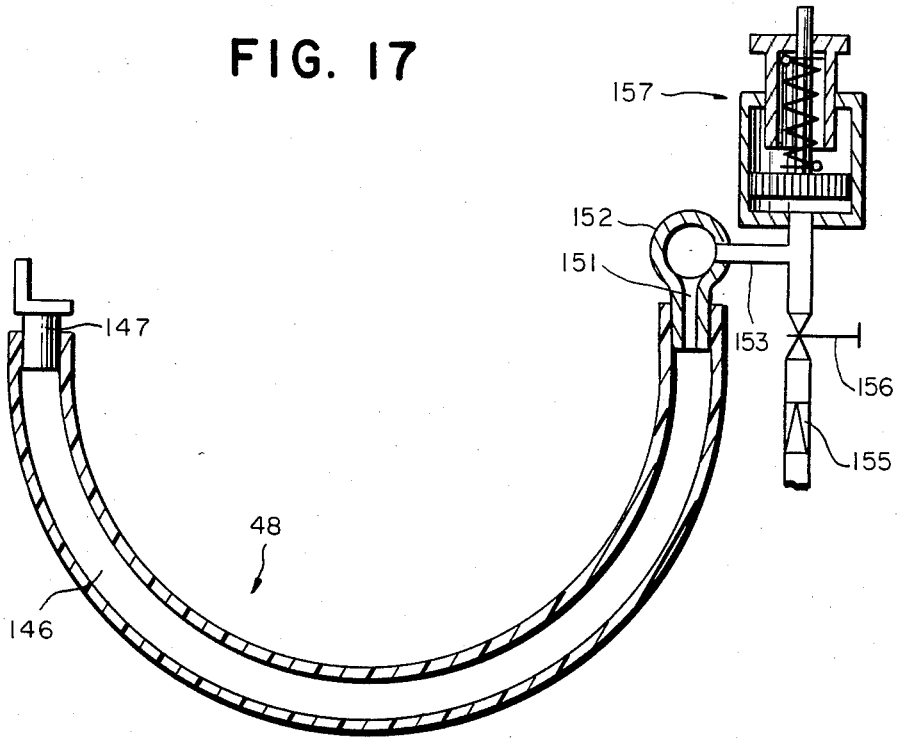
FIGS. 17 to 20 are sections through a pump support with adjustable support pressure.
Figure 18:
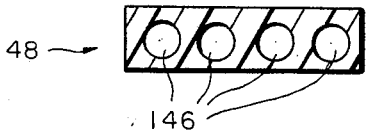
Figure 19:
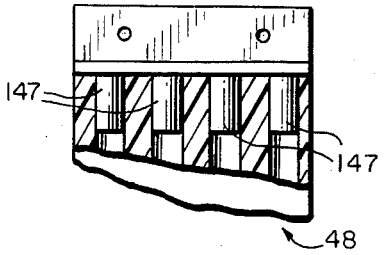
Figure 20:
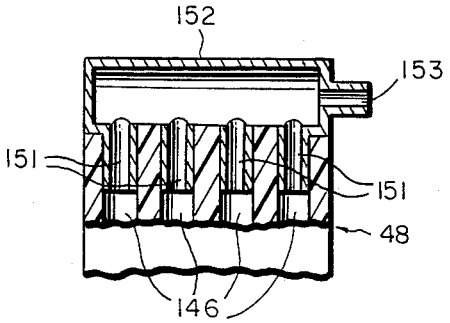

In order to compensate for variations of the width of the dividing member as the result of heating, for example when hot liquids are pumped, it is advantageous for the cover 43 to be composed of a plurality of layers, namely with a resilient intermediate layer 116 and a metal plate 115 along which the dividing member 34 slides (FIG. 15).

Figure 16:
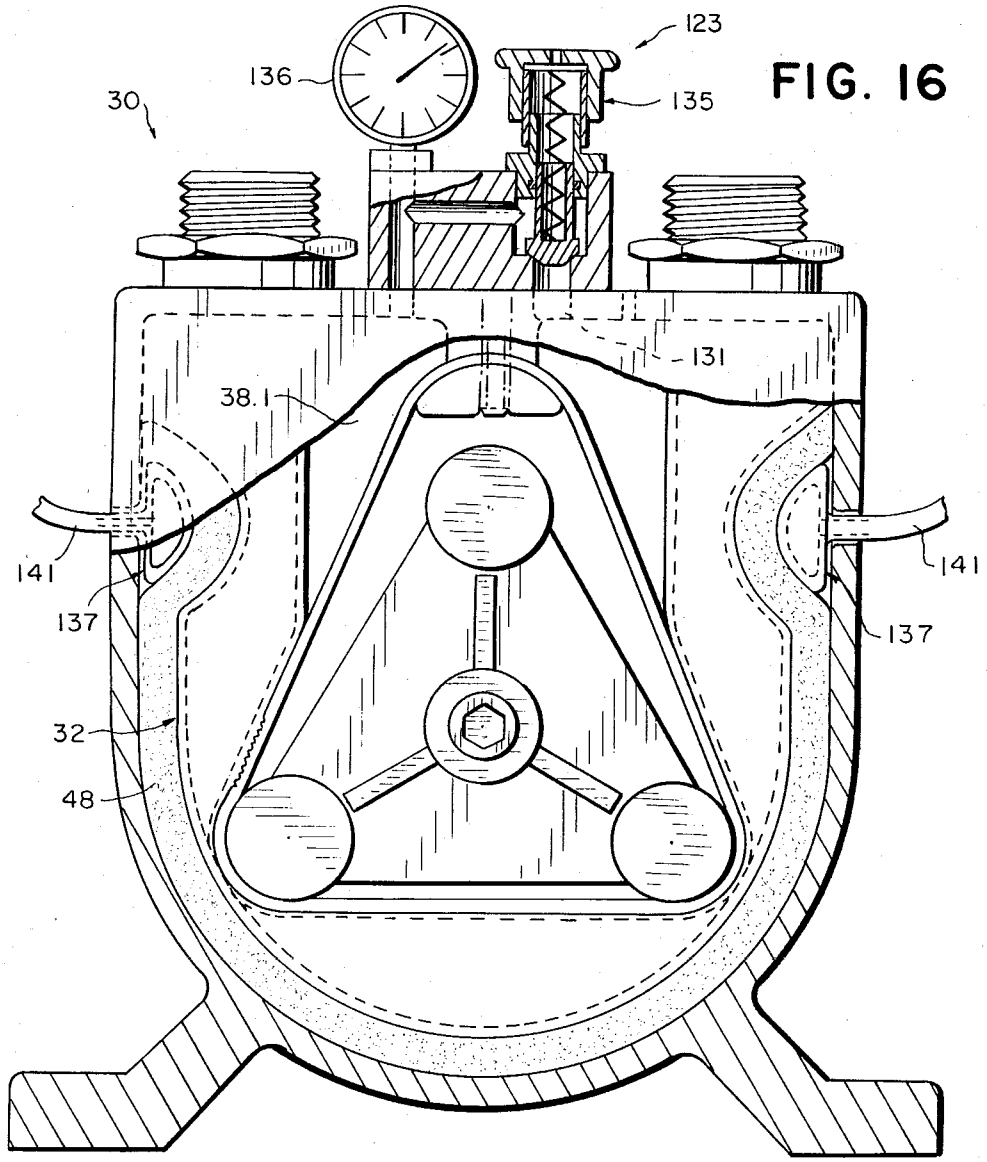
FIG. 16 is a longitudinal section corresponding to FIG. 1, but through a pump having pulsation dampers and a snifting valve.

The suction chamber 38.1 is connected to a vacuum gauge 136 in the embodiment shown in FIG. 16. In addition, a snifting valve 123 with an adjusting device 136 is provided and allows air to pass through a through hole 131 from the delivery chamber 38.2 into the suction chamber 38.1. The negative pressure in the suction chamber 38.1, and thus the suction head of the pump, can thereby be adjusted. Moreover, two pulsation dampers 137 are provided, one near the delivery branch and one near the suction branch. Each pulsation damper 137 consists of a moulded member in communication with the atmosphere by way of a supply pipe 141.

With any stricture pump it is desired to be able to stop the delivery of the pump despite the rotation of the rotor. With a pump according to the present application, this can be achieved either with the aid of the adjusting device 135, as already described, or with the aid of an embodiment of the type which will now be described with reference to FIGS. 17 to 20. In this embodiment an inflatable support 48 is provided. The inflation is effected by way of pipe-like cavities 146 in the support. If the support 48 is firmly inflated, the hose 32 will be completely compressed between it and the dividing member 34 at the location of a roller 52. If on the other hand the support 48 is only slightly inflated or even not inflated at all, the hose will no longer be sufficiently squeezed, so that fluid will be able to flow back from the delivery side to the suction side and thus the delivery of the pump will be stopped. The cavities 146 in the embodiment illustrated are closed on one side by a closure stopper 147, while on the other side compressed air is fed from a pressure reservoir 157 to each pipe-like cavity 146 through a manifold 152 and individual pipes 151. The reservoir receives compressed air by way of a pressure reducing valve 155 and a shut-off valve 156.

Figure 21:
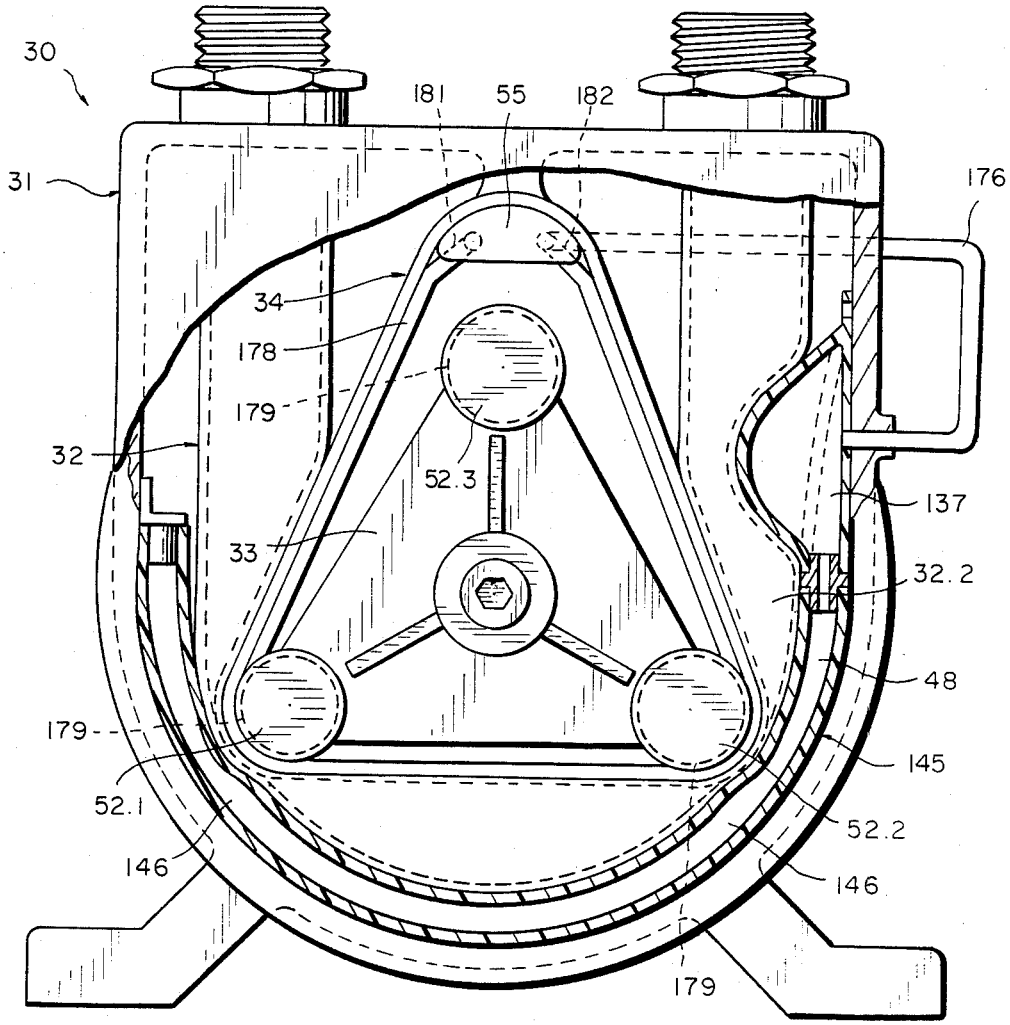
FIGS. 21 to 23 are sections through a pump corresponding to FIG. 1, but having a secondary stricture pump.
Figure 22:
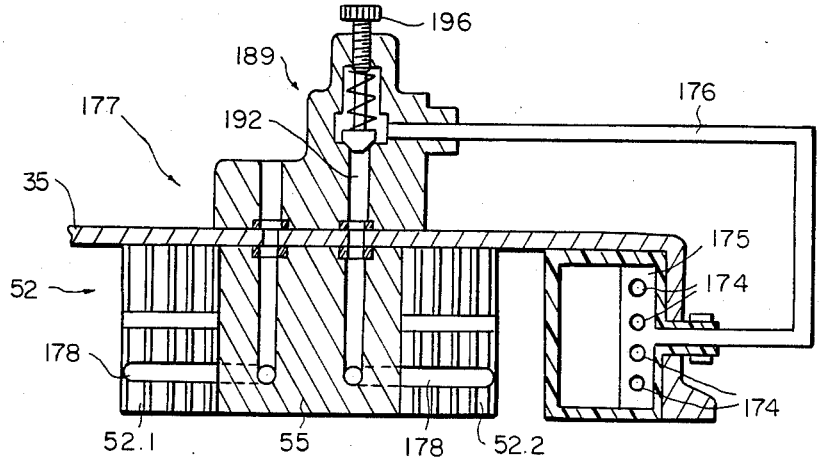
Figure 23:
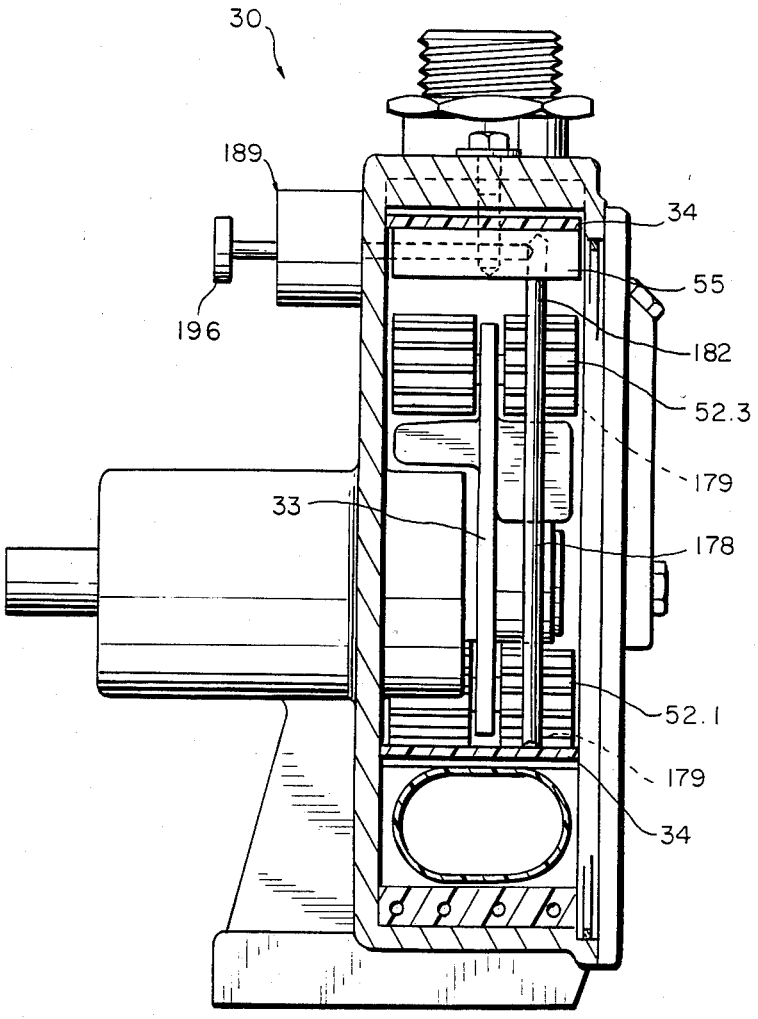

The compressed air required for inflating the support 48 in the embodiment shown in FIGS. 17 to 20 can be produced by a stricture pump 30 itself constructed according to FIGS. 21 to 23. This stricture pump is equipped with a secondary stricture pump 177 having a secondary delivery hose 178 which is disposed along the inner face of the dividing member 34 from a secondary suction branch 181 to a secondary delivery branch 182. In each of the rollers 52 a peripheral groove 179 is recessed, through which the secondary delivery hose 178 is guided. The groove is however only sufficiently deep for the compressed secondary delivery hose 178 to be accommodated in it. Air flows from the secondary delivery branch 182 through a connecting pipe 176 into a wall part 175, in which the air is introduced via through holes 174 into individual pipe-like cavities 146 in the support 48. The pressure of the air is adjustable by means of a valve 189 provided with an adjusting screw 196. That end of the support 48 on the delivery side is in the form of a pulsation damper 137 in the embodiment shown in FIG. 21.

In all pumps it is possible to use as the dividing member 34, instead of a closed band, an open band which is fastened at both ends to the casing 31. Instead of rollers, it is possible to use any constricting members, even members which only slide, that is to say do not roll, and whose axes are parallel and concentric to the axis of the rotor.

In the pumps according to the invention the deliverable flow can also easily be varied by replacing the hoses by hoses of different cross-section. Care must merely be taken to see that the outer circumference of the hose corresponds at most to twice the distance between the two flat boundary walls. Adjustment of output in this way by the use of hoses having different cross-sections is not possible in the case of conventional stricture pumps, because the entire design of the pump is adapted in respect of depth and diameter to the diameter of a clearly determined hose.

In principle the pump will function even with a single constricting member rotating inside the dividing member. For practical purposes however, at least two constricting members are provided. It is advantageous to use three or four such members.

I claim:

1. Stricture pump comprising:

a casing (31) having a peripheral wall (37) which, at least in a pump portion connecting a suction chamber (38.1) to a delivery chamber (38.2) in the casing, is of circular cylindrical shape, a flat rear end wall (35) which closes the casing at the rear, a flat front wall (36, 43) which closes the casing at the front, a suction branch (45) through which the fluid to be pumped is drawn by suction into the suction chamber, and a delivery branch (46) through which the fluid is forced out of the delivery chamber, a rotor (33) which rotates, in the interior space (38) of the casing, in the direction from the suction chamber to the delivery chamber, whose rotor axis coincides with the cylinder axis of the pump portion, and a hose (32) which is disposed, between the suction branch (45) and the delivery branch (46), along the peripheral wall (37), whose periphery corresponds at most to twice the distance between the rear end wall (35) and the front wall (43), and which has substantially no restoring power of its own, characterised in that the rotor (33) has at least two constricting members (52) whose axes are disposed concentrically around the axis of the rotor, a dividing member is provided which is in the form of a band and is substantially stable in respect of length, and which in the interior space (38) between the delivery chamber (38.2) and the suction chamber (38.1) is fastened to a fastening part (53, 55, 57) outside the outermost periphery of the rotor, in such a manner as to be fixed to the casing and in addition is disposed around the rotor and, at least in its suction chamber portion, has a width such that on the rotation of the rotor at least the suction chamber portion is pushed to and fro sealingly in relation to the rear end wall (35) and the front wall (36, 43), whereby the suction chamber is vacuum-tightly divided off from the delivery chamber, the hose (32) lies between the inner wall of the pump portion and the dividing member, and in the interior space (38) of the casing (31) a sealing liquid is provided.

2. Pump according to claim 1, characterised in that the hose (32) has an elongate cross-sectional shape and is so disposed that the long axis of the cross-section lies parallel to the peripheral wall (37).

3. Pump according to claim 1, characterised by a secondary stricture pump (177) having at least one delivery hose (178) which is disposed on the inner side of the dividing member (34).

4. Pump according to claim 1, characterised in that the suction chamber is in communication with an adjustable air inlet valve (123).

5. Pump according to claim 1, characterised in that a connection (81, 82, 85, 86) is provided between the interior space surrounded by the dividing member (34) and the space between the dividing member and the peripheral wall, which connection permits the passage of the sealing liquid from the space between the dividing member and the peripheral wall into the interior space.

6. Pump according to claim 1, characterised in that the front wall is formed by an annular front end wall (36) joined to the peripheral wall (37) and by a cover (43) which closes the opening left free by the annular end wall.

7. Pump according to claim 1, characterised in that the dividing member (34) is provided with a sealing lip (101, 102) at each of its two longitudinal edges (99, 100).

8. Pump according to claim 1, characterised in that the dividing member (34) is provided with transverse corrugation (97) on its outer side facing the peripheral wall (37).

9. Pump according to claim 1, characterised in that the dividing member (34) is provided with transverse corrugation on its inner side.

10. Pump according to claim 1, characterised in that a resilient layer (109) is provided externally on the dividing member (34).

11. Pump according to claim 1, characterised in that a resilient layer (48) is provided on the pump portion of the peripheral wall (37).

12. Pump according to claim 11, characterised in that the resilient layer (48) has inflatable cavities (146) through the inflation of which the pressing power of the hose (32) between the dividing member (34) and the layer is adjustable.

* * * * *